US010411394B2

(12) United States Patent
Chen

(10) Patent No.: US 10,411,394 B2
(45) Date of Patent: Sep. 10, 2019

(54) CONNECTOR WITH LATCH PROTECTION

(71) Applicant: Po-Hung Chen, New Taipei (TW)

(72) Inventor: Po-Hung Chen, New Taipei (TW)

( * ) Notice: Subject to any disclaimer, the term of this patent is extended or adjusted under 35 U.S.C. 154(b) by 0 days.

(21) Appl. No.: 16/124,200

(22) Filed: Sep. 7, 2018

(65) Prior Publication Data

US 2019/0123476 A1 Apr. 25, 2019

(30) Foreign Application Priority Data

Oct. 20, 2017 (TW) ..... 106215484 U

(51) Int. Cl.

| | |
|---|---|
| ***H01R 29/00*** | (2006.01) |
| ***H01R 13/506*** | (2006.01) |
| ***H01R 13/6585*** | (2011.01) |
| ***H01R 13/405*** | (2006.01) |
| ***H01R 12/71*** | (2011.01) |
| ***H01R 13/627*** | (2006.01) |
| ***H01R 13/6583*** | (2011.01) |
| *H01R 24/60* | (2011.01) |
| *H01R 107/00* | (2006.01) |

(52) U.S. Cl.

CPC ..... *H01R 13/506* (2013.01); *H01R 12/716* (2013.01); *H01R 13/405* (2013.01); *H01R 13/6275* (2013.01); *H01R 13/6583* (2013.01); *H01R 13/6585* (2013.01); *H01R 24/60* (2013.01); *H01R 2107/00* (2013.01)

(58) Field of Classification Search

CPC ..... H01R 103/00; H01R 13/7635; H01R 13/633; H01R 13/637; H01R 33/05

USPC ..... 439/188, 159, 160, 152–155

See application file for complete search history.

(56) References Cited

U.S. PATENT DOCUMENTS

2016/0020568 A1* 1/2016 Ju ..... H01R 4/78 439/607.01

* cited by examiner

*Primary Examiner* — Phuong Chi T Nguyen

(74) *Attorney, Agent, or Firm* — Fei-hung Yang

(57) ABSTRACT

A connector with latch protection includes a metal casing, an insulating body, plural metal terminals and a partition. The insulating body covers the interior of the metal casing and has a tab extended forwardly from the front of the insulating body and disposed apart on the top and bottom of the tab respectively, and both sides of the tab corresponding to a connecting plug form an inwardly concave portion, and both sides of the partition have a protection plate corresponding to each inwardly concave portion and the front of the tab and bent and extended forwardly. When the partition is embedded into the insulating body by a molding method, a portion of the two metal protection plates exposed from the tab forms a pair of latch grooves for latching the connecting plug to effectively improve the durability and life and lower the manufacturing cost of the connector significantly.

18 Claims, 9 Drawing Sheets

CONNECTOR WITH LATCH PROTECTION

CROSS-REFERENCE TO RELATED APPLICATIONS

This non-provisional application claims priority under 35 U.S.C. § 119(a) on Patent Application No(s). 106215484 filed in Taiwan, R.O.C. on Oct. 20, 2017, the entire contents of which are hereby incorporated by reference.

FIELD OF INVENTION

The present invention relates to the field of electrical connectors, in particular to a connector with latch protection having a protection plate bent and extended to the front from both sides of a partition, and the partition is embedded into an insulating body by a molding method to form a metal latch groove for the latching purpose in order to improve the durability and life of use and lower the manufacturing cost significantly.

BACKGROUND OF INVENTION

1. Description of the Related Art

In recent years, various mobile electronic products including Smartphones, tablet PCs and notebook computers tends to be developed with a thin design and a high performance, and thus related electronic components are also developed with the thin and high-performance features. In addition, the mobile electronic products are generally connected to many electronic components to meet with the application requirements of high-speed signals and limited by the reduced volume, and the electromagnetic interference issue becomes increasingly serious. Therefore, how to arrange the circuit design while taking the electromagnetic interference protection into consideration at the same time is an important subject for related manufacturers. Since the electronic signal is transmitted by the current passing between the terminals, each terminal is affected by the flow of current to generate a magnetic field at the outer side of the terminal according to the Oersted's Law of Electromagnetism. If the overall volume of the connector is reduced to cause a smaller gap between the terminals, the electromagnetic interference (EMI) between the terminals will be increased (particularly during a high frequency transmission) and thus affecting the accuracy and efficiency of signal transmissions.

In addition to the aforementioned issue of high frequency signal transmissions, there is another issue of having a signal loss or interrupt caused by an incomplete latch of the connector. In general, the connector is made of a material of combined plastic and metal, so that inwardly concave portions are arranged at appropriate plugging positions to improve the stability of connection, and the inwardly concave portions can be latched to the latch terminals effectively for a stable use of the terminals. However, the plastic portion of the material may be born out after a long time of use, and the latching effect may become poor, and a tight connection cannot be achieved to affect the signal receiving effect.

To improve the stability and extend the service life effectively, an inwardly concave portion and a latch terminal made of metal and commercially available in the market are adopted, and these components come with an appropriate elasticity, and the metal inwardly concave portion becomes the concave portion, so that the latch terminals can be contacted successfully to achieve a stable connection effect, and these metal inwardly concave portions or protective structures are usually manufactured by a special manufacturing method such as a casting or forging method. Undoubtedly, these methods incur a higher manufacturing cost. Moreover, the insulating body must be divided into upper and lower halves to be embedded into the inwardly concave portions respectively, so that the inwardly concave portions are clamped therein for a fixation or covered onto the exterior of the insulating body. However, these designs not just results in a more complicated structure and increase the manufacturing cost only, but also lose the elasticity to affect the stability of actual use. Obviously, these designs require further improvements.

In view of the aforementioned drawbacks of the conventional relay, the inventor of the present invention based on years of experience in the related industry to conduct extensive research and experiment, and finally developed a connector with a latch protection effect to overcome the drawbacks of the prior art.

2. Summary of the Invention

Therefore, it is a primary objective of the present invention to provide a connector with latch protection, where a protection plate bent and extended to the front from both sides of a partition is adopted, and a molding method is used to embed the partition together with a portion of the two protection plates into an insulating body, so as to form a pair of metal latch grooves for the latching purpose, and the pair of metal grooves are provided for improving the durability and life of use and lowering the manufacturing cost.

To achieve the aforementioned and other objectives, the present invention provides a connector with latch protection, for plugging together with a connecting plug to define an electrical and signal connection, comprising: a metal casing, having a containing space formed therein, and a support leg separately surrounded the metal casing and used for a fixing purpose, and the support legs being electrically coupled a circuit board; an insulating body, covering the interior of the metal casing, and having a tab extended forwardly from the front end of the insulating body, a plurality of grooves formed at the top and bottom of the tab and further extended to the rear end of the insulating body, and an inwardly concave portion disposed separately at both edges of the tab and configured to be corresponsive to the connecting plug; a plurality of metal terminals, each having a front section disposed at the top and bottom of the tab in each groove to form a first power terminal, and a rear section passing out from the rear end of the insulating body to form a second power terminal; and a partition, made of metal, and having both sides corresponding to each of the inwardly concave portion and integrally formed with a protection plate which extends forwardly, and the partition covering the interior of the insulating body through a molding method to separate the metal terminals at the top and bottom of the tab, and a portion of the two protection plates being embedded into the tab, and a latch groove being formed at a position corresponding to the two inwardly concave portions, and a portion of the partition being coupled to the metal casing, so that the metal terminals is free of electromagnetic interference.

In an embodiment, the partition is formed by a stamping process, and each protection plate is bent from a side towards a surface and perpendicular to the partition, such that the midline position of each protection plate is disposed on a plane of the partition, and the front of the two protection plates has a fixing portion corresponding to the middle of the tab. In addition, the two protection plates have a width greater than the thickness of the partition.

To improve the stability of the assembly, the present invention provides various forms of the fixing portion as described below. 1. Each fixing portion is bent with a step difference from the protection plate to form a flap. 2. Each fixing portion is bent perpendicular to the protection plate to form a flap. 3. Each fixing portion has a through hole. 4. Each fixing portion has at least a notch. The aforementioned flap, through hole, or notch can be used for covering and embedding the front end of the tab after the partition is embedded into the insulating body to achieve the effect of improving the assembling stability.

In addition, the connector with latch protection of the present invention further comprises a protective cover, and both sides of the partition have a latch hole, and both ends of the protective cover have a latch portion disposed at positions corresponding to the pair of the latch holes respectively, for installing the protective cover onto the partition.

In addition, at least an embedded hole is formed at the front end of the partition and provided for covering and embedding the front end of the tab after the partition is embedded into the insulating body, so as to achieve the effect of improving the assembling stability.

DESCRIPTION OF THE PREFERRED EMBODIMENTS

To make it easier for our examiner to understand the objective, technical characteristics, structure, innovative features, and performance of the invention, we use preferred embodiments together with the attached drawings for the detailed description of the invention.

Figure 1:
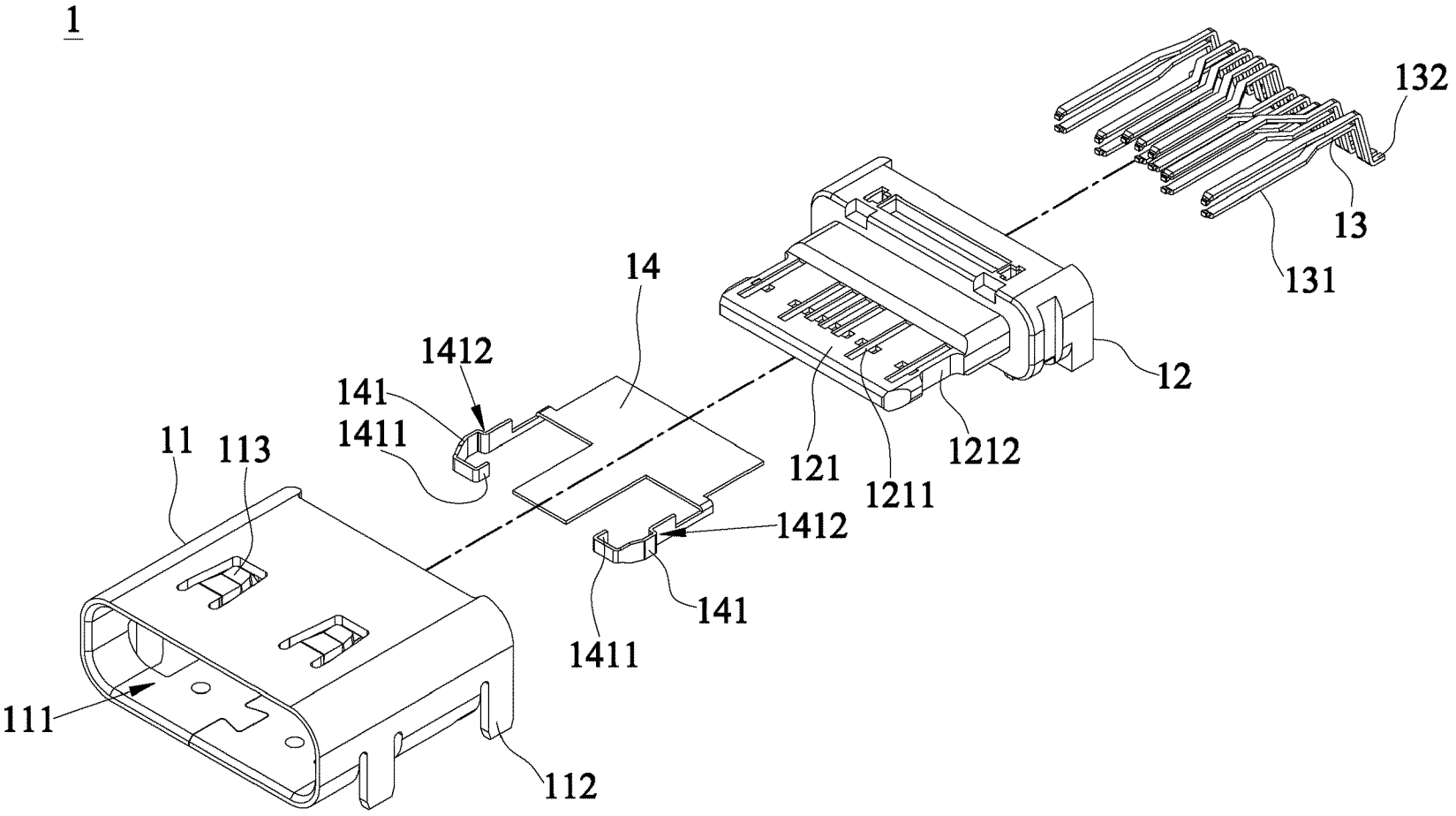
FIG. 1 is an exploded view of a connector with latching effect in accordance with a preferred embodiment of the present invention.
Figure 2:
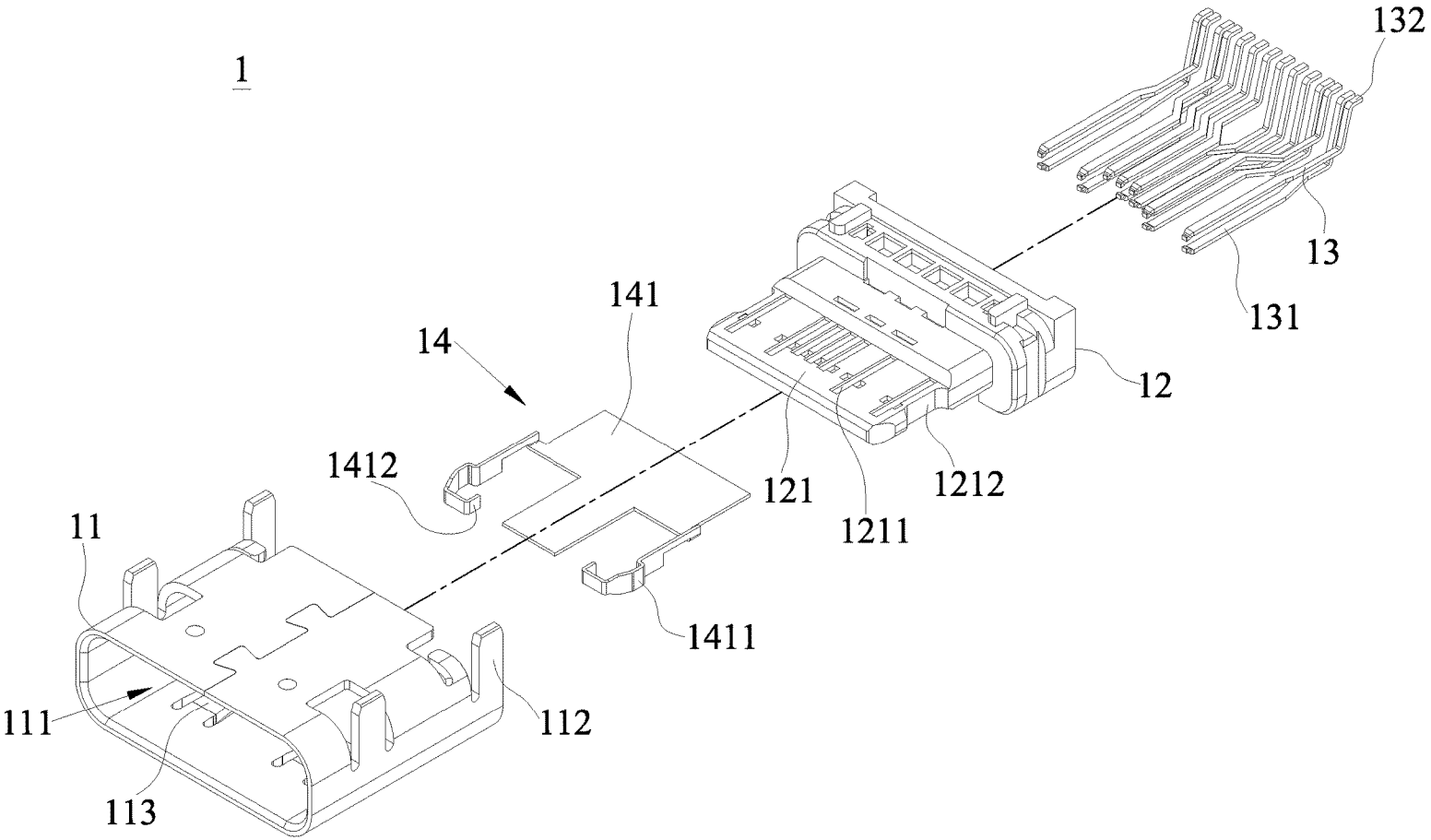
FIG. 2 is another exploded view of a connector with latching effect in accordance with a preferred embodiment of the present invention.
Figure 3:
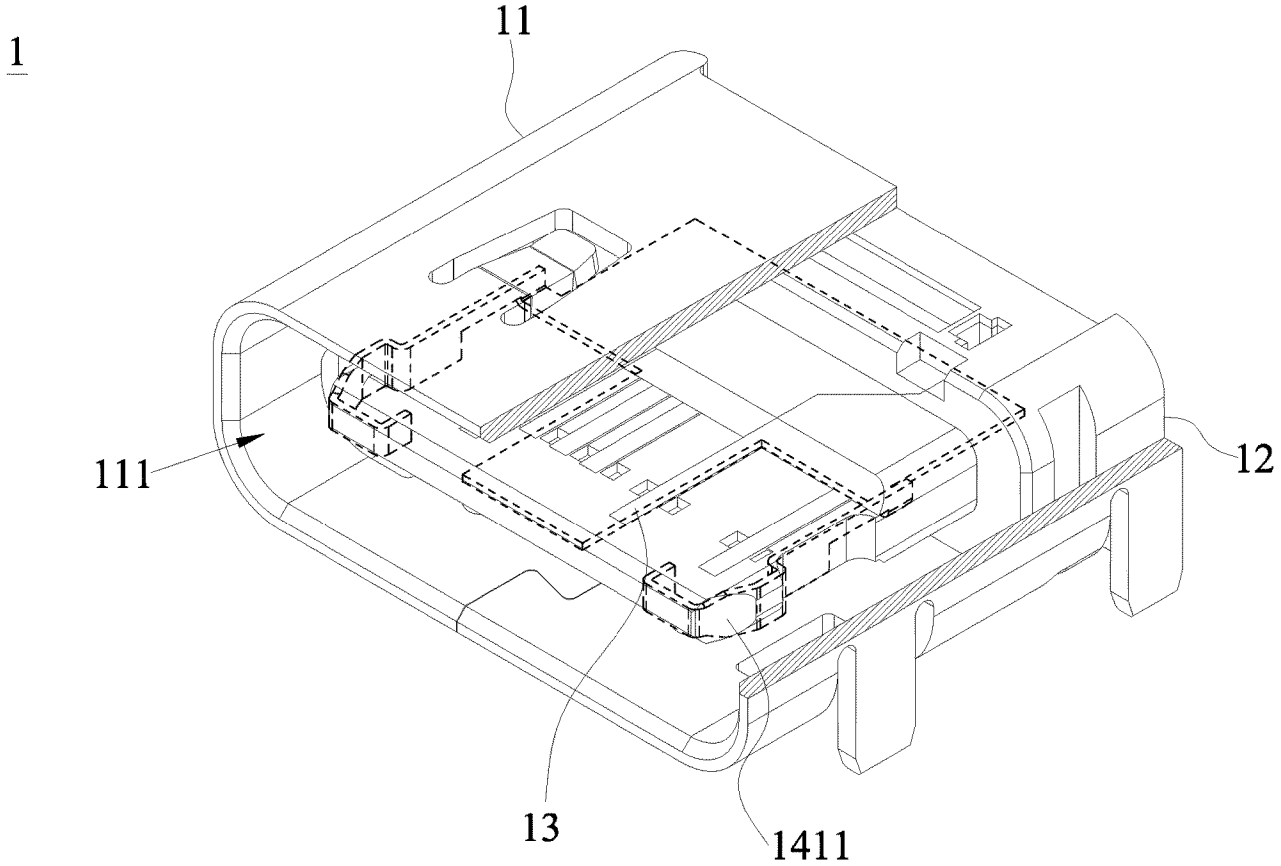
FIG. 3 is a perspective view of an assembled connector with latching effect in accordance with a preferred embodiment the present invention.
Figure 4:
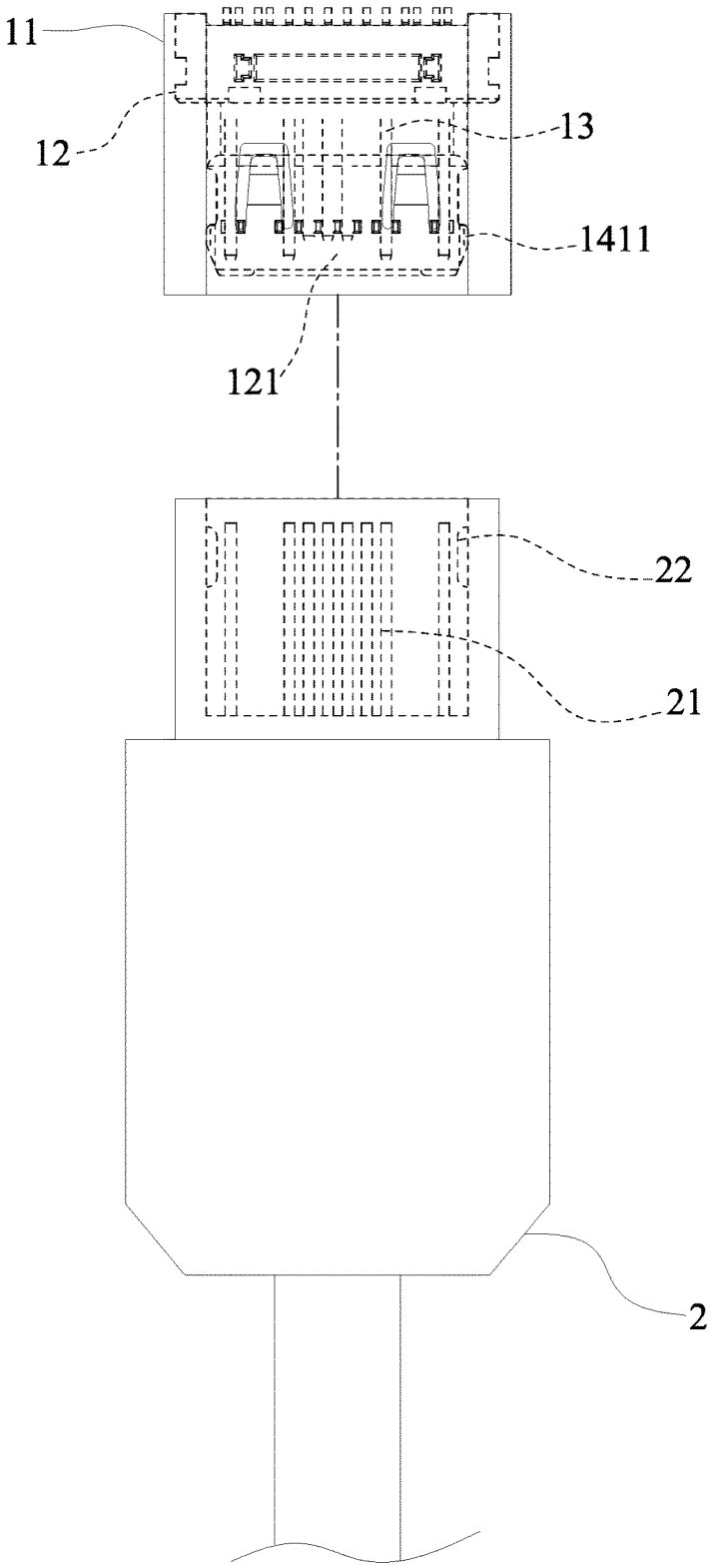
FIG. 4 is a first schematic view of using a connector with latching effect in accordance with a preferred embodiment the present invention.
Figure 5:
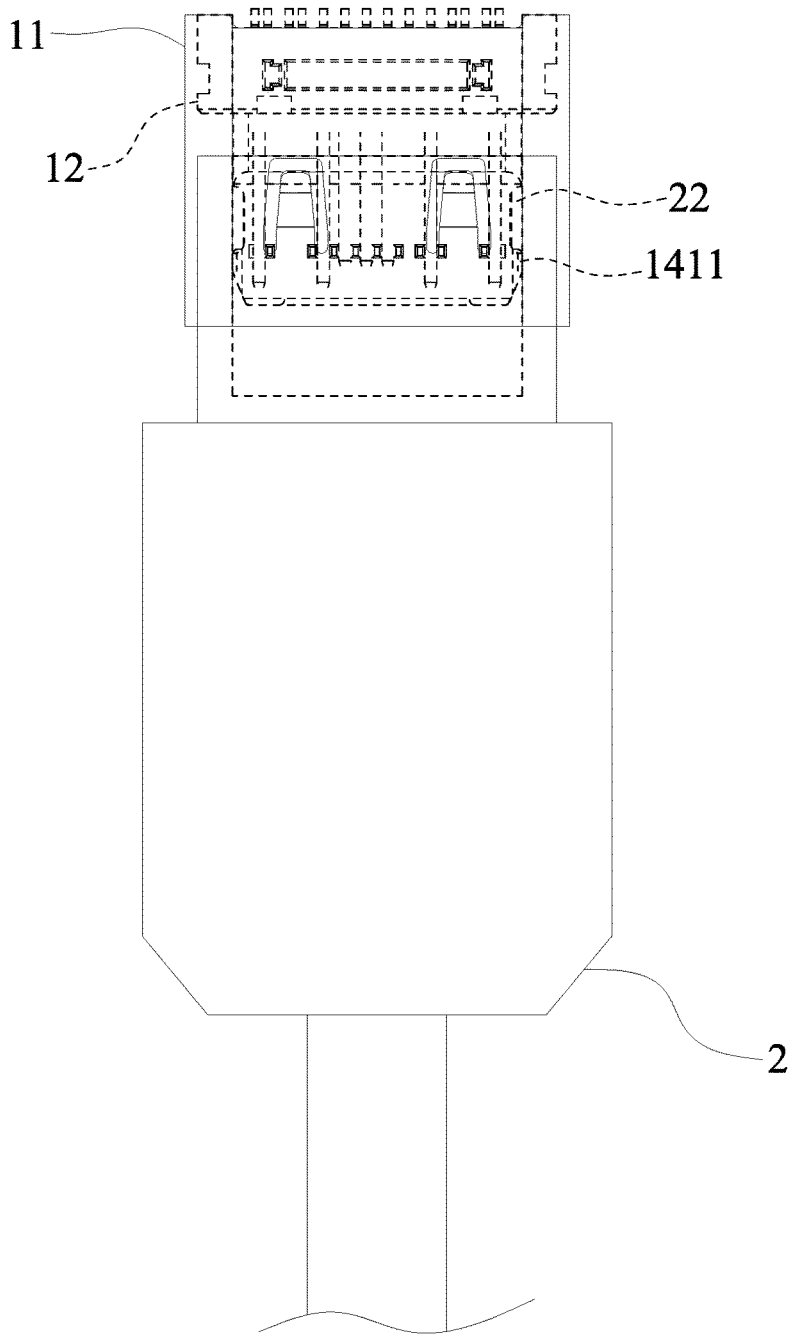
FIG. 5 is a second schematic view of using a connector with latching effect in accordance with a preferred embodiment the present invention.

With reference to FIGS. 1, 2, 3 and 4~5 for two exploded views, a perspective view, and two schematic views of a connector with latch protection in accordance with a preferred embodiment of the present invention respectively, the connector with latch protection effect 1 comprises a metal casing 11, an insulating body 12, a plurality of metal terminals 13 and a partition 14, and the connector 1 is provided for plugging together with a connecting plug 2 to define an electrical and signal connection, and the connecting plug 2 has a plurality of power connection portions 21 with an interior configured to be corresponsive to the metal terminals 13, and both sides of the power connection portions 21 have a latch terminal 22.

Wherein, the metal casing 11 has a containing space 111 therein, and the surrounding of the exterior of the metal casing 11 has a support leg 112 provided for the fixing purpose and fixed to an edge of a circuit board. It is noteworthy that the metal casing 11 of the present invention is in a MICRO USB TYPE C shape, and its front is in the shape of a long elliptical shape, and the metal casing 11 has a pair of elastic arms 113 concavely formed at the top of the metal casing 11 for providing a clamping force when the connecting plug 2 is inserted.

The insulating body 12 covers the interior of the metal casing 11 and has a tab 121 extended from the front end of the insulating body 12 and completely covered inside the metal casing 11, and the top and bottom of the tab 121 have a plurality of grooves 1211 extended to the rear end of the insulating body 12, and two edges of the tab 121 have an inwardly concave portion 1212 configured to be corresponsive to the connecting plug 2.

The front section of the each metal terminal 13 is disposed in each groove 1211 at the top and bottom of the tab 121 to form a first power terminal 1311, and an end of the rear section of each metal terminal 13 passing out from the rear of the insulating body 12 is formed into a second power terminal 1312, and the first power terminals 1311 are contacted with the power connection portions 21 of the connecting plug 2 to define an electrical connection, and the second power terminals are provided for electrically connecting a circuit of the circuit board.

The partition 14 is manufactured by a stamping process by a molding method to cover the insulating body 12 and provided for separating the metal terminals 13 at the top and bottom of the tab 121, so as to prevent electromagnetic interference occurred during a high frequency transmission, wherein the partition 14 is in an inverted hollow-T shaped, and both sides of the partition 14 are configured to be corresponsive to the front end of the tab 121 and the external profile of the two inwardly concave portions 1212 and have two protection plates 141, and each protection plate 141 is bent perpendicular to the partition 14 from a side towards the same side, so that the midline position of each protection plate 141 is disposed on the plane of the partition 14. In other words, the side is substantially in a transversal T-shape, and the front end of the two protection plates 141 has a fixing portion 1411 configured to be corresponsive to the middle of the tab 121, so that each fixing portion 1411 of each protection plate 141 is provided for embedding and covering in the tab 121 during the manufacturing process, and each protection plate 141 is bent and has a latch groove 1412 formed at the positions corresponding to the two inwardly concave portions 1212. It is noteworthy that the two protection plates 141 have a width greater than the thickness of the partition 14 for forming a protection area when the latch terminal 22 is latched into the latch groove 1412. In other words, the present invention uses the two metal protection plates 141 in contact with the latch terminal 22 to effectively reduce the worn-out or damage caused by plugging the connecting plug 2. Compared with the design of the commercial products with just a portion manufactured by an expensive method, the present invention adopts the partition 14 and the two protection plates 141 manufactured by a stamping process can be mass produced quickly to lower the manufacturing cost. Actual tests show that the two protection plates 141 can protect the tab 121 and the two inwardly concave portions 1212 from being worn out or damaged effectively.

Figure 6:
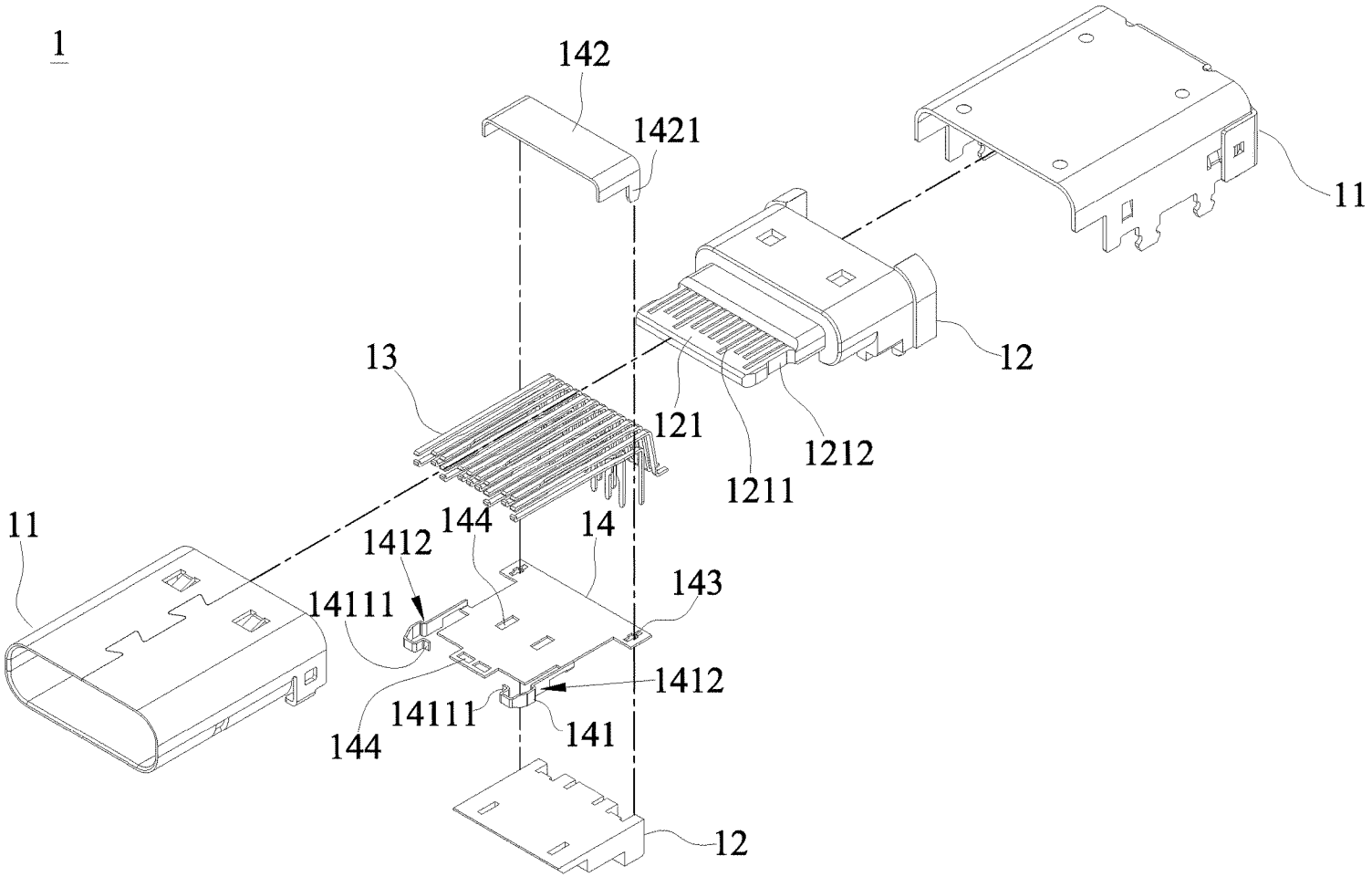
FIG. 6 is a first implementation mode of a preferred embodiment of the present invention.
Figure 7:
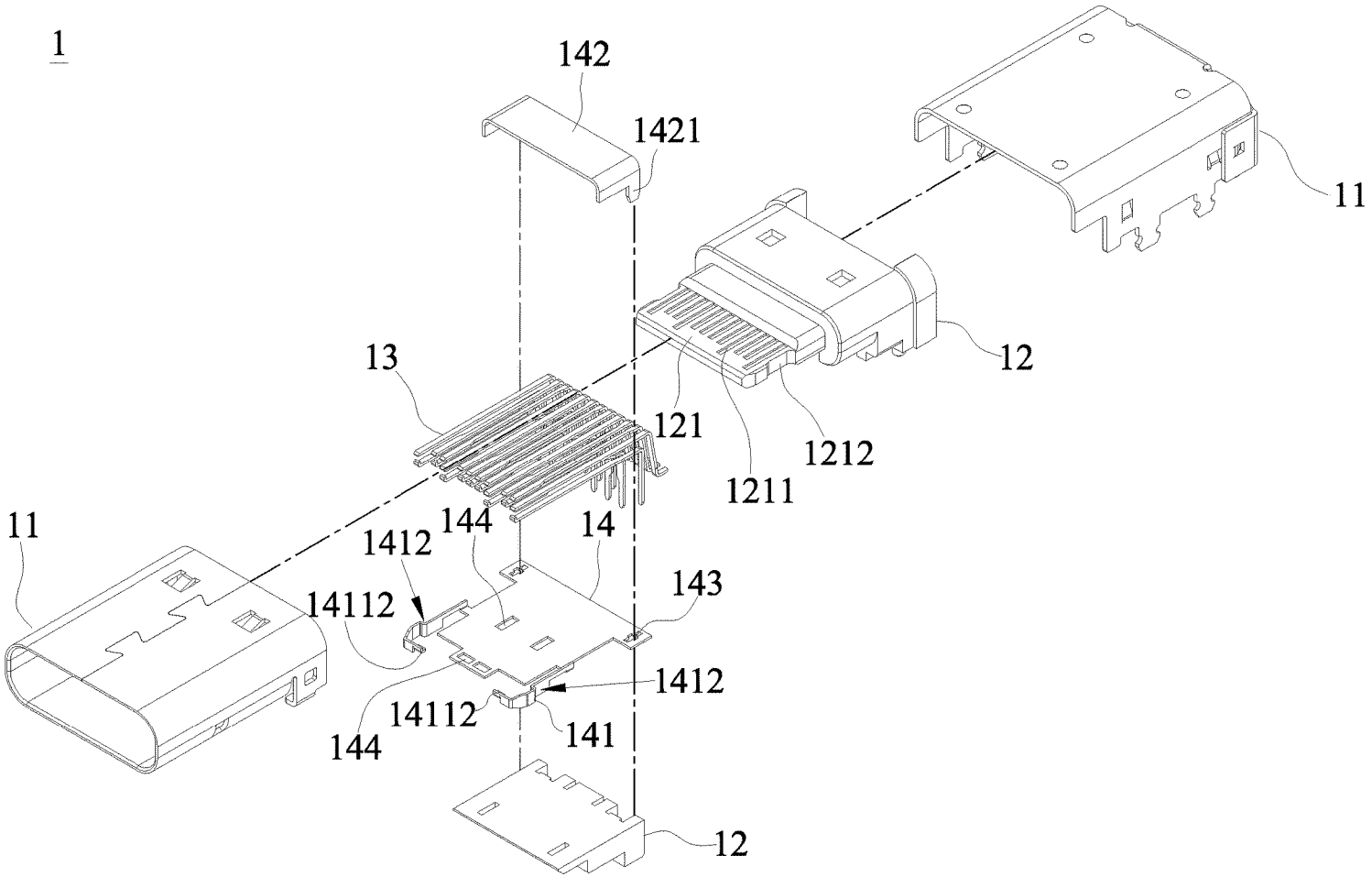
FIG. 7 is a second implementation mode of a preferred embodiment of the present invention.
Figure 8:
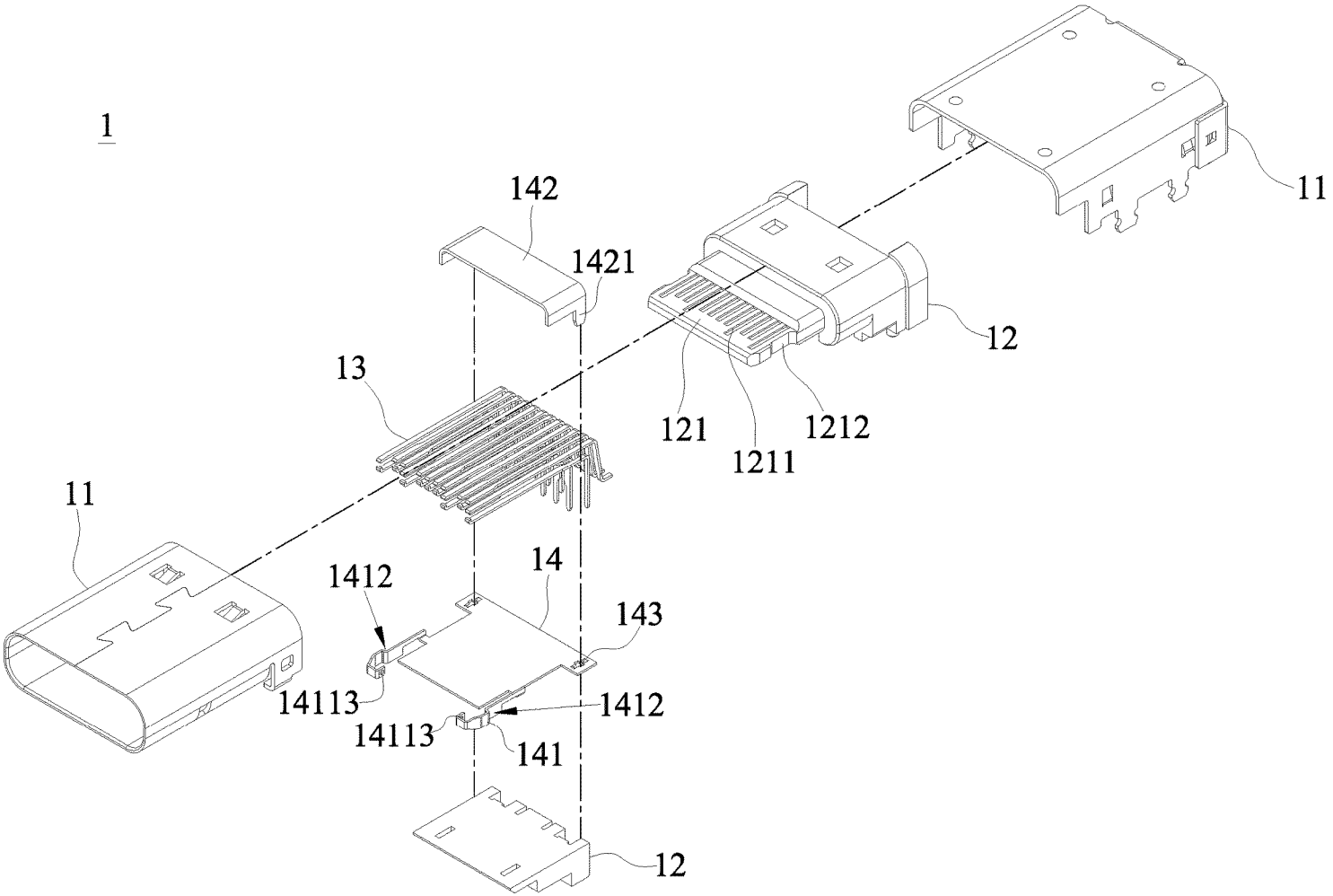
FIG. 8 is a third implementation mode of a preferred embodiment of the present invention.
Figure 9:
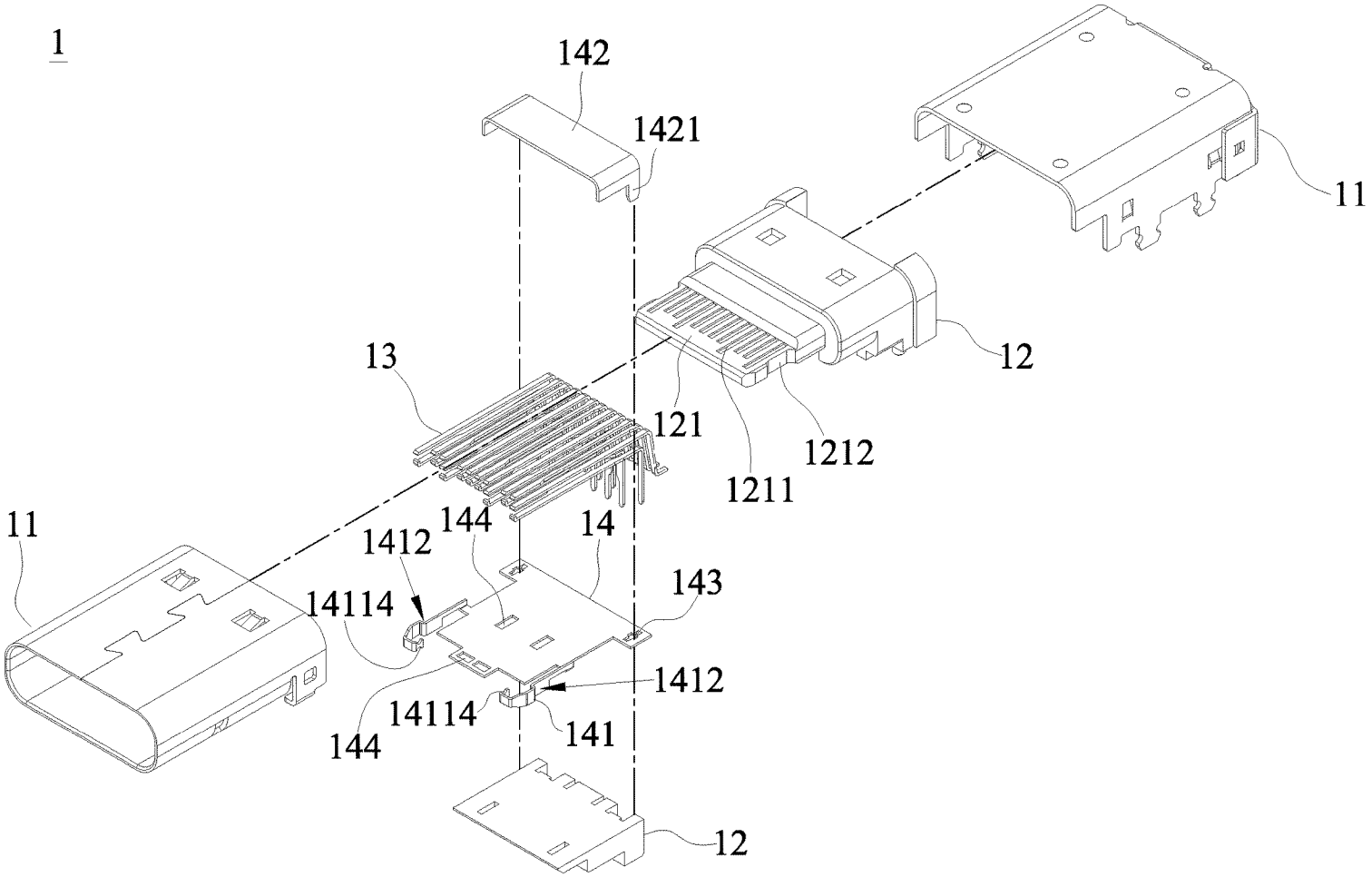
FIG. 9 is a fourth implementation mode of a preferred embodiment of the present invention.

With reference to FIGS. 6 to 9 for different implementation modes of the protection plate of the present invention respectively, the present invention provides the following types of the fixing portion 1411 to improve the assembling stability. 1. Each fixing portion 1411 is bent with a step difference from the protection plate 141 to form a flap 14111. 2. Each fixing portion 1411 is bent perpendicular to the protection plate 141 to form a flap 14112. 3. Each fixing portion 1411 has a through hole 14113. 4. Each fixing portion 1411 has at least a notch 14114 formed at two edges of the front end of each fixing portion 1411. The aforementioned flap 14111, 14112, through hole 14113 or notch 14114 can be used for covering and embedding the front end of the tab 121 after the partition 14 is embedded into the insulating body 12 to achieve the effect of improving the assembling stability.

In addition, the connector with latch protection 1 of the present invention further comprises a protective cover 142, a latch hole 143 formed separately on both sides of the partition 14, and a latch portion 1421 disposed separately at both ends of the protective cover 142 and configured to be corresponsive to the pair of the latch holes 143 respectively for installing the protective cover 142 onto the partition 14. In addition, the partition 14 has at least an embedded hole 144 provided for embedding the front end of the tab 121 after the partition 14 is embedded into the insulating body 12 to achieve the stable assembling effect.

When use, the connecting plug 2 is passed into the metal casing 11, and the interior of the connecting plug 2 covers the tab 121, and the latch terminals 22 disposed on both sides of the connecting plug 2 can be latched tightly to the two latch grooves 1413. Now, the latch terminals 2 will not be contacted with the tab 121 directly during the plugging process but will slide along the exterior of the protection plate 1411, so as to achieve the effect of preventing the worn-out of the tab 121. After the plugging process, the power connection portions 21 abut against the first power terminals 131 tightly to define an electrical conduction.

What is claimed is:

1. A connector with latch protection, for plugging together with a connecting plug to define an electrical and signal connection, comprising:

a metal casing, having a containing space formed therein, and a support leg separately surrounding the metal casing and used for a fixing purpose, and the support legs being electrically coupled to a circuit board;

an insulating body, covering the interior of the metal casing, and having a tab extended forwardly from a front end of the insulating body, a plurality of grooves being formed at top and bottom of the tab and further extended to a rear end of the insulating body, and an inwardly concave portion being disposed separately at both edges of the tab and configured to be corresponsive to the connecting plug;

a plurality of metal terminals, each having a front section disposed at the top and bottom of the tab in each of the plurality of grooves to form a first power terminal, and a rear section passing out from a rear end of the insulating body to form a second power terminal; and a partition, made of metal, and having both sides corresponding to each of the inwardly concave portion and integrally formed with a protection plate which extends forwardly, and the partition covering the interior of the insulating body through a molding method to separate the metal terminals at the top and bottom of the tab, and a portion of the two protection plates being embedded into the tab, and a latch groove being formed at a position corresponding to two inwardly concave portions, and a portion of the partition being coupled to the metal casing, so that the metal terminals is free of electromagnetic interference, wherein the partition is formed by a stamping process, and each protection plate is bent from a side towards a surface and perpendicular to the partition, such that a midline position of each protection plate is disposed on a plane of the partition, and a front of the two protection plates has a fixing portion corresponding to the middle of the tab, wherein the two protection plate have a width greater than a thickness of the partition, wherein each fixing portion is bent with a step difference from the protection plate to form a flap for embedding in the tab.

2. The connector with latch protection according to claim 1, further comprising a protective cover, wherein a latch hole is formed separately on both sides of the partition, a latch portion is disposed separately at both ends of the protective cover and configured to be corresponsive to the pair of latch holes for installing the protective cover onto the partition.

3. The connector with latch protection according to claim 2, wherein the partition has at least an embedded hole formed at a front of the partition for embedding in the tab.

4. The connector with latch protection according to claim 1, wherein each fixing portion has a through hole for embedding in the tab.

5. The connector with latch protection according to claim 4, further comprising a protective cover, wherein a latch hole is formed separately on both sides of the partition, a latch portion is disposed separately at both ends of the protective cover and configured to be corresponsive to the pair of latch holes for installing the protective cover onto the partition.

6. The connector with latch protection according to claim 5, wherein the partition has at least an embedded hole formed at a front of the partition for embedding in the tab.

7. The connector with latch protection according to claim 1, wherein each fixing portion has at least a notch for embedding in the tab.

8. The connector with latch protection according to claim 7, further comprising a protective cover, wherein a latch hole is formed separately on both sides of the partition, a latch portion is disposed separately at both ends of the protective cover and configured to be corresponsive to the pair of latch holes for installing the protective cover onto the partition.

9. The connector with latch protection according to claim 8, wherein the partition has at least an embedded hole formed at a front of the partition for embedding in the tab.

10. A connector with latch protection, for plugging together with a connecting plug to define an electrical and signal connection, comprising:

a metal casing, having a containing space formed therein, and a support leg separately surrounding the metal casing and used for a fixing purpose, and the support legs being electrically coupled to a circuit board;

an insulating body, covering the interior of the metal casing, and having a tab extended forwardly from a front end of the insulating body, a plurality of grooves being formed at top and bottom of the tab and further extended to a rear end of the insulating body, and an inwardly concave portion being disposed separately at both edges of the tab and configured to be corresponsive to the connecting plug;

a plurality of metal terminals, each having a front section disposed at the top and bottom of the tab in each of the plurality of grooves to form a first power terminal, and a rear section passing out from a rear end of the insulating body to form a second power terminal; and a partition, made of metal, and having both sides corresponding to each of the inwardly concave portion and integrally formed with a protection plate which extends forwardly, and the partition covering the interior of the insulating body through a molding method to separate the metal terminals at the top and bottom of the tab, and a portion of the two protection plates being embedded into the tab, and a latch groove being formed at a position corresponding to two inwardly concave portions, and a portion of the partition being coupled to the metal casing, so that the metal terminals is free of electromagnetic interference, wherein the partition is formed by a stamping process, and each protection plate is bent from a side towards a surface and perpendicular to the partition, such that a midline position of each protection plate is disposed on a plane of the partition, and a front of the two protection plates has a fixing portion corresponding to the middle of the tab, wherein the two protection plate have a width greater than a thickness of the partition, wherein each fixing portion is bent perpendicularly from the protection plate to form a flap for embedding in the tab.

11. The connector with latch protection according to claim 10, further comprising a protective cover, wherein a latch hole is formed separately on both sides of the partition, a latch portion is disposed separately at both ends of the protective cover and configured to be corresponsive to the pair of latch holes for installing the protective cover onto the partition.

12. The connector with latch protection according to claim 11, wherein the partition has at least an embedded hole formed at a front of the partition for embedding in the tab.

13. The connector with latch protection according to claim 10, wherein each fixing portion has a through hole for embedding in the tab.

14. The connector with latch protection according to claim 13, further comprising a protective cover, wherein a latch hole is formed separately on both sides of the partition, a latch portion is disposed separately at both ends of the protective cover and configured to be corresponsive to the pair of latch holes for installing the protective cover onto the partition.

15. The connector with latch protection according to claim 14, wherein the partition has at least an embedded hole formed at a front of the partition for embedding in the tab.

16. The connector with latch protection according to claim 10, wherein each fixing portion has at least a notch for embedding in the tab.

17. The connector with latch protection according to claim 16, further comprising a protective cover, wherein a latch hole is formed separately on both sides of the partition, a latch portion is disposed separately at both ends of the protective cover and configured to be corresponsive to the pair of latch holes for installing the protective cover onto the partition.

18. The connector with latch protection according to claim 17, wherein the partition has at least an embedded hole formed at a front of the partition for embedding in the tab.

* * * * *